United States Patent [19]

McRoskey et al.

[11] 3,989,153

[45] Nov. 2, 1976

[54] SAFETY CAP

[75] Inventors: John W. McRoskey, Los Angeles; Delbert D. Swartz, Torrance; Leonard H. McRoskey, Los Angeles, all of Calif.

[73] Assignee: Republic Tool & Manufacturing Corporation, Los Angeles, Calif.

[22] Filed: Feb. 6, 1976

[21] Appl. No.: 655,714

[52] U.S. Cl. ..... 215/220

[51] Int. Cl.[2] ..... B65D 55/02; B65D 85/56; A61J 1/00

[58] Field of Search ..... 220/218, 219, 220, 330, 220/331

[56] References Cited

UNITED STATES PATENTS

| | | | |
|---|---|---|---|
| 3,396,864 | 8/1968 | Jones et al. | 215/220 X |
| 3,857,505 | 12/1974 | Mumford et al. | 215/220 |
| 3,917,098 | 11/1975 | Acton | 215/219 |

*Primary Examiner*—George T. Hall

*Attorney, Agent, or Firm*—Whann & McManigal

[57] ABSTRACT

A safety cap having means for signalling when the cap is tightly screwed onto the container comprising a cap member and a driver member surrounding the cap member with inner engaging means positioned between the driver member and the cap member for rotating the cap member in a direction to screw it onto the neck of the container, the means giving a signal when the cap is tightly screwed in place.

9 Claims, 8 Drawing Figures

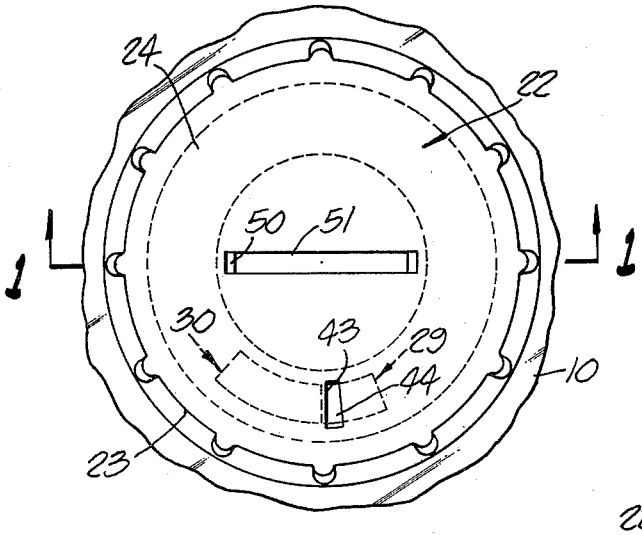
FIG. 2.
FIG. 1.
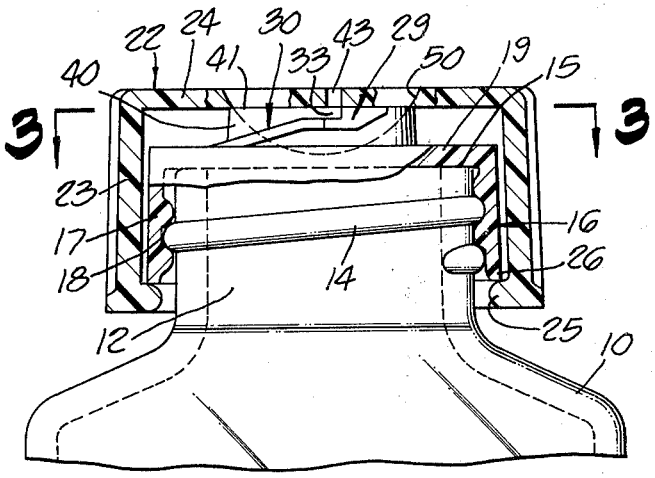
FIG. 4.
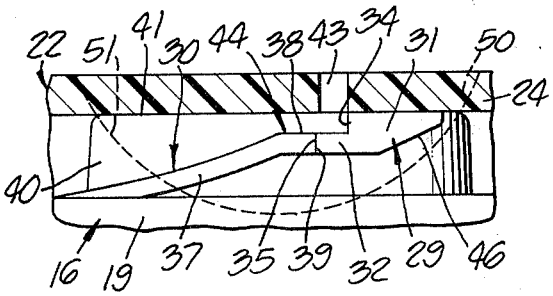
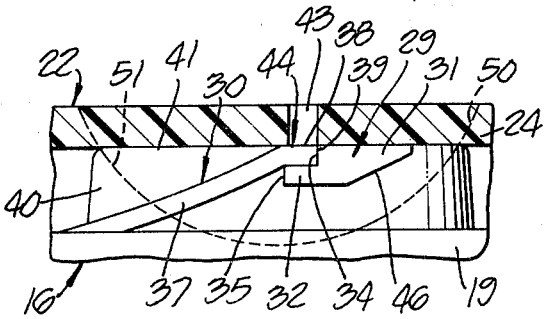
FIG. 5.
FIG. 3.
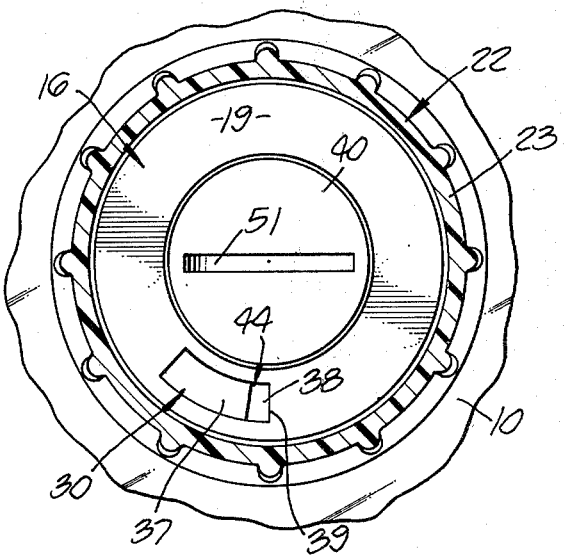

SAFETY CAP

BACKGROUND OF THE INVENTION

Legislation has been enacted requiring child-proof caps for containers of harmful or dangerous ingredients, such as liquid or powder or pill medicines or acids, etc. Many different safety caps have been designed to be tamper-proof. Most ideas involve a driver which rotates freely on the cap in an unscrewing direction and employs special manipulation or means not known to the child, whereby the driver may be caused to unscrew the cap from the container.

Such designs are shown in the patents to Haynes U.S. Pat. No. 2,994,447, Thornton U.S. Pat. No. 3,019,931, Mumford U.S. Pat. No. 3,147,873, Peterson U.S. Pat. No. 3,394,829, Petronelli, et al. U.S. Pat. No. 3,669,294, Gach U.S. Pat. No. 3,679,085, Gach U.S. Pat. No. 3,722,727, Taylor U.S. Pat. No. 3,729,110 and DeFelice U.S. Pat. No. 3,734,331.

There is a remote danger that in the original bottling operation the cap will not be tightly screwed in place, or of an adult, when using the medication or pills or dangerous ingredient, to be in a hurry or through inadvertence not to rescrew the cap tightly in place, with the result that a child playing with the container or trying to remove the cap, will, because of its looseness, get the cap off the bottle.

There is, therefore, a need for a simple, effective means which will assure that in these cap assemblies having the driver element which encloses the cap, which will give a signal that the cap is or has been tightly secured in place. With such a device the danger of a child removing the cap will be reduced to a minimum.

SUMMARY OF THE INVENTION

It is, therefore, an object of our invention to provide a safety cap which gives a signal when the cap has been tightly secured in place. This signal may be given by feel, by audibility or visuality.

It is an object of our invention to provide a safety cap having a drive means cooperating between a cap and driver member which, when the driver member is rotated and an adequate pressure has been applied to the cap, to cause it to be tightly secured to the container, a signal will be given by yieldable parts which permit a slight additional movement of the driver, which additional movement will be felt by the person applying the cap and also there will be a snap-like sound which the person can hear.

It is another object of our invention to provide a device of the character described in the preceding paragraph in which the signal given is a visual signal.

It is a still further object of our invention to provide, in a safety cap of the type heretofore referred to, a structure which is simple and effective and which will have relatively long-life so that regardless of how many times the cap is removed and replaced on the bottle, at each replacement the signal will be given that the cap has been tightly screwed home.

Other objects and advantages of our invention will be made apparent in the course of the following detailed description of preferred forms of our invention.

BRIEF DESCRIPTION OF THE DRAWINGS

FIG. 1 is an elevational view of the end of a bottle showing the safety cap of our invention in place thereon taken on the line 1—1 of FIG. 2.

FIG. 2 is a plan view of FIG. 1;

FIG. 3 is a sectional view taken on line 3—3 of FIG. 1;

FIG. 4 is an enlarged fragmentary view showing the co-engaging parts of our invention in a position in which the cap of our invention is being screwed onto the neck of the bottle, these parts being in the position as shown in FIG. 1;

FIG. 5 is a fragmentary sectional view similar to FIG. 4, but with the co-engaging parts moved into a final position wherein the cap of our invention has been screwed tightly in place;

DESCRIPTION OF THE INVENTION

Figure 6:
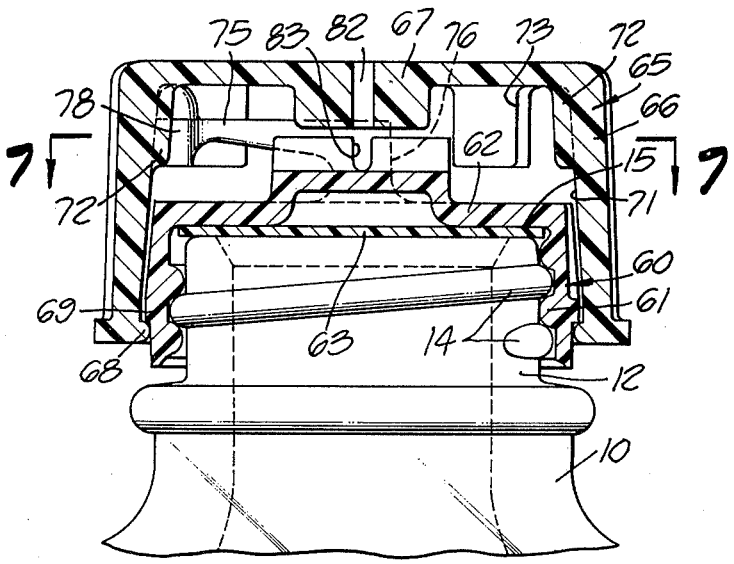
FIG. 6 is a vertical sectional view similar to FIG. 1, but of an alternative form of our invention.

Referring to FIGS. 1 to 5 of the drawings, the numeral 10 is a bottle or container or receptacle having a cylindrical projection 12 providing a mouth or neck. The projection 12 is cylindrical and has external threads 14 on the exterior thereof. The projection 12 terminates in an upper radial end wall 15.

Our invention provides a cap 16 for closing the container, the cap 16 having a cylindrical wall 17 with internal threads 18 and an end wall 19 adapted to tightly engage the wall 15 of the projection 12 when the cap is screwed tightly in place.

Our invention provides a driver 22 which is in the form of an enclosure having a cylindrical wall 23 which surrounds the cylindrical wall of the cap, a radial end wall 24 positioned above the end wall 19 of the cap and a retaining lip 25 which extends below the lower end 26 of the cap. It will be noted that there is a small clearance between the cap and the driver to permit relative rotation between those parts. However, the driver encloses the cap and cannot be removed from the cap.

Our invention provides means for rotating a cap into a tight position on the neck of the container so that the walls 15 and 19 are tightly engaged and so that there will be no leakage, and so that the cap will not inadvertently loosen on the neck of the bottle.

This means which is provided cooperates between the cap and the driver and consists of two parts. The first part 29 is secured to the driver, and the second part 30 is secured to the cap. The part 29 includes a base 31 secured to the lower surface of the end wall 24 and extending from the base 31 is a lip 32 which forms a pocket 33. This structure forms two shoulders, one of which is shoulder 34, which is mounted in pocket 33, and the other of which is shoulder 35, which is formed on the end of the lip 32. The shoulder 34 forms a stop and the shoulder 35 forms a driving wall.

The second part 30, which is mounted on the cap 16, has a yieldable arm 37, which is secured to the upper surface of the end wall 19 of the cap 16. The arm 37 is inclined as shown and integral with the free end of the arm 37 is an end portion 38, which is in a horizontal plane in alignment with the lip 32. The portion 38 has an engaging wall 39, which is engaged by the driving wall 34 when the cap is being rotated into place.

When the driver is rotated in a clockwise position the end walls or shoulders 35 and 39 are brought into engagement with each other. It is important that these parts be aligned, and this alignment is provided for by a central abutment 40 formed on the end wall 19 of the cap 16 which projects upwardly from the cap and has a surface 41 which engages the lower surface of the end wall 24 of the driver 22, and in this way the parts 32 and 38 are held in alignment.

When the cap has been rotated into the position shown in FIG. 1 the pressure of the lip 32 against the end portion 38 has forced the cap 16 tightly in place. At this time the cap seals the end of the bottle and the cap will not inadvertently move from place.

The parts are now in the position shown in FIG. 1 and in FIG. 4. Further manual rotation of the driver 22 increases the pressure of part one against part two. Under this increase in pressure the arm 37, which is flexible, bends upwardly, and in its upward movement moves into alignment with the pocket 33. At this instance the shoulder 39 slips from the shoulder 35 and the parts snap into the position shown in FIG. 5. At this instance the movement of the cap can be felt and it is, thereupon known that the cap has been tightly screwed into place. Also, there is a snapping sound which is audible and this gives a second signal.

In addition to this there is an additional visual signal. The end wall 24 of the driver is provided with a window 43 aligned with the pocket 33. The upper surface of the portion 38 is colored at 44. When the parts have snapped into the position shown in FIG. 5 the color 44 is visible through the window 43.

At this time it is known that the cap has been screwed home with adequate tightness, that it won't leak and will not inadvertently come loose. Further rotation of the driver in a clockwise direction merely serves to screw the cap into place even tighter. Rotation of the driver in the opposite direction, that is, anti-clockwise direction, does not affect the position of the cap. As the driver is rotated in an anti-clockwise direction the inclined face 46 of part 29 rides along the arm 37 of part 30 and pushes the upper end of the arm downwardly so that part 29 can move above part 30.

Any suitable means can be provided for enabling the cap to be removed and the cap removal can be accomplished by providing a slot 50 in the end wall 24 of the driver which slot may be aligned with a recess 51 in the abutment 40. This provides for the insertion of a coin which directly engages a part of the cap 16 and enables it to be unscrewed.

The parts 29 and 30 may be reversed and also may be mounted on circumferential walls, as well as radial walls.

Figure 7:
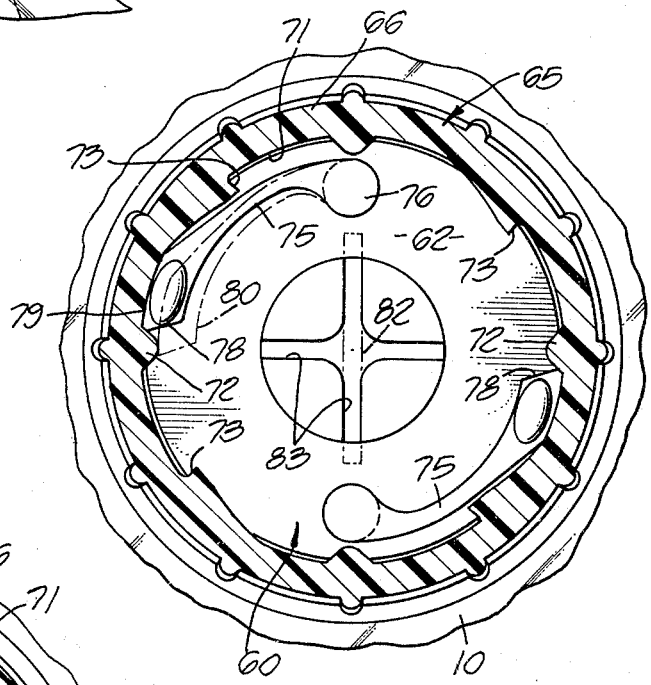
FIG. 7 is a cross-sectional view taken on the line 7—7 of FIG. 6 showing the parts in position during the tightening of the cap in place.
Figure 8:
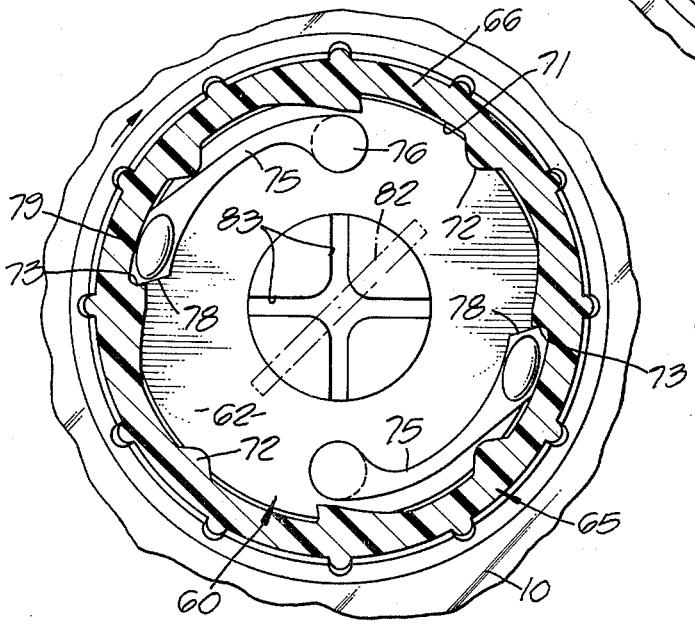
FIG. 8 is a cross-sectional view similar to FIG. 7 but in which the parts are in a final position with the cap screwed tightly in place.

In FIGS. 6 to 8 inclusive, we show an alternative form of our invention in which the co-engaging parts of the driver and the cap are rotated to engage on circumferential walls.

In the second form of our invention the cap is adapted to be screwed onto the externally threaded projection 12 of the bottle or container 10. The cap has a cylindrical wall 60 having internal threads 61 which engage the external threads 14 of the bottle. The cap 60 has an end wall 62 and there is provided a sealing gasket 63 between the lower surface of the end wall 62 and the end wall 15 of the projection 12.

The driver 65 has a cylindrical wall 66, a radial end wall 67, and an inwardly extending lip 68, which extends below a shoulder 69 of the cap 60, and in this way the cap is surrounded and the driver is rotatably supported thereon.

The inner cylindrical surface 71 of the cylindrical wall 66 is provided with a series of driver projections 72 and stops 73. The driver projections have convex curved walls while the stops are concave and provide pockets.

On the end wall 62 of the cap are mounted arms 75, the arms being mounted at mounts 76 and these parts may be cast integral if the parts of the invention are made from a plastic or flexible castable material.

The arms 75 may be flexible or the mounting portion 76 may be flexible so that the ends of the arms may be swung inwardly when sufficient pressure is applied to the ends thereof. The ends of the arms have an end face 78 and an outer arcuate face 79. The arms are urged outwardly so as to engage the inner surface 71 of the driver.

In screwing the cap 60 into place the driver is rotated in a clockwise direction, moving the driving projection or lug 72 into engagement with the end 78 of the arm 75. When the cap has been screwed into the position shown in FIG. 6 and the cap has been tightened in place, pressure against the end of the arm increases and the arm is swung inwardly into dotted line position 80 of FIG. 7, and when the arm is released and moves by the lug 72 there is a sudden movement of the driver, and when the end of the arm engages in the pocket stop 73 there is an audible signal. Further movement of the driver will merely tend to further tighten the cap on the bottle projection even beyond the safe tightening which is assured when the arm 75 snaps past the driving lug 72.

To rotate the cap in an anti-clockwise direction to remove it from the bottle a coin may be inserted through the slot 82 in the end wall of the driver into one of the slots 83 formed in the upper portion of the cap 62. The relationship of the slot 82 and slots 83 is such that upon unscrewing the cap the cap and driver are aligned by insertion of the coin so that the ends 78 of the arms 75 are positioned as shown in FIG. 7 ready to engage the driver projections 72 upon rotation of the driver in a clockwise direction.

In this form of the invention a plurality of co-engaging driving and driven parts are provided. In other words, there are two arms 75 and a plurality of pairs of driving lugs and stops 72 and 73.

It is not necessary to have more than one of the two co-engaging parts in either form of our invention.

We claim:

1. In a safety cap of the character described, the combination of:

a. a cap member adapted to be screwed onto a container;

b. a driver member rotatably supported by said cap;

c. means cooperating between said cap member and said driver member, including driver means on said driver member and driven means on said cap member, said driver and driven means co-engaging when said driver member is rotated in a direction to screw said cap on said container; and d. said driver means or said driven means releasing to give a signal when said cap member is tightly screwed on said bottle.

2. A combination as defined in claim 1 in which said means cooperating between said cap member and said driver member includes a yieldable element which yields under pressure and permits relative movement of said cap member and said driver member after said cap member has been screwed into place.

3. A combination as defined in claim 2 in which one of said driver or driven means has a lip and an adjacent pocket, and the other of said driver or driven means has a portion which engages said lip when said driver member is screwing said cap member into place, and in which said portion snaps past said lip and into said pocket when said cap member is tightly screwed on said container.

4. A combination as defined in claim 2 in which when said driver member is rotated in a direction to remove said cap from said container, said yieldable part moves so as to readily move past other parts of said means cooperating between the cap member and the driven member so that said driver member cannot rotate said cap member in a direction to unscrew said cap from said container.

5. A combination as defined in claim 3 in which said lip guards said stop against engagement when said driver member is being rotated in a direction to remove said cap member.

6. A combination as defined in claim 2 in which one of said driver means or driven means includes at least a portion which is yieldable in order to permit relative movement between the cap member and the driver member when said cap has been screwed into place, and in which there is a stop means which comes into operation after said further relative movement in order to restrain said cap member and said driven member from further relative movement irrespective of the pressure applied to the driver member.

7. A combination as defined in claim 6 in which one of said driver means or driven means has a base, a projecting lip forming a pocket, and a stop wall in said pocket, and the other of said driver means or driven means has a yieldable portion and an end which engages the end of said lip and which, when the cap member has been screwed into place on the container and pressure increases between said driver and driven members causes said yieldable portion to snap past the end of said lip and into said pocket and in engagement with said stop wall.

8. A combination as defined in claim 1 in which said driver member encloses said cap member and includes an end wall adjacent to an end wall of said cap member, and in which said driver means is mounted on the innerface of said end wall of said driver member, and in which said driven means is mounted on the outer surface of the end wall of said cap member.

9. A combination as defined in claim 3 in which said driver member encloses said cap member and in which there is a window in said driver member through which it may be observed whether or not a portion of the driven means is in said pocket.

* * * * *